United States Patent [19]

Hadley et al.

[11] 4,014,449

[45] Mar. 29, 1977

[54] SAFETY CAP

[75] Inventors: John R. Hadley, San Rafael; Michel A. LeBrun, Jr., Sebastopol; John W. McRoskey; Leonard H. McRoskey, both of Los Angeles; Delbert D. Swartz, Torrance, all of Calif.

[73] Assignee: Republic Tool & Manufacturing Corporation, Los Angeles, Calif.

[22] Filed: May 14, 1976

[21] Appl. No.: 686,411

[52] U.S. Cl. ..... 215/215; 215/219

[51] Int. Cl.[2] ..... B65D 55/02; B65D 85/56; A61I 1/00

[58] Field of Search ..... 215/207, 215, 219

[56] References Cited

UNITED STATES PATENTS

| | | | |
|---|---|---|---|
| 3,164,277 | 1/1965 | Reading | 215/215 |
| 3,396,864 | 8/1968 | Jones et al. | 215/215 |

*Primary Examiner*—George T. Hall

*Attorney, Agent, or Firm*—Whann & McManigal

[57] ABSTRACT

A safety closure for a container comprising an inner cap with a top and cylindrical collar having threads mating with threads on the container and a central longitudinal extending recess; an outer cap having a top and a cylindrical collar fitting concentrically about the collar of the inner cap, the outer cap being freely rotatable relative to the inner cap in the direction of loosening the inner cap member from the neck of the container, having cooperable locking means with the inner cap for tightening the inner cap member on the neck of the container, the top of the outer cap having a central longitudinal extending opening adapted to be moved into and out of alignment with the recess on the inner cap member by rotation of the outer cap member relative to the inner cap member; and means to prevent insertion of a key device into the aligned opening and recess without the application of pressure on the key device.

7 Claims, 5 Drawing Figures

SAFETY CAP

BACKGROUND OF THE INVENTION

1. Field

The present invention relates to a safety closure for a container. More particularly, the present invention relates to a safety closure for a container requiring several steps to remove the safety closure from the container.

2. Prior Art

Numerous patents have issued in the area of safety closures for bottles. Many of these safety closures require the use of a key to remove the cap. See for example U.S. Pat. Nos. 3,485,402, 3,160,301, 3,501,041 and 3,164,277. The latter patent discloses a bottle cap having an inner and outer cap member which must be brought into a certain alignment before insertion of a key, e.g., a coin, to remove the cap. Many of the prior art safety closures only offer limited protection in preventing a young child from removing the safety closure.

SUMMARY OF THE INVENTION

In order to prevent accidental removal of a cap from a bottle containing poisons or otherwise dangerous materials or subsequent accidental usage or ingestion of the contents thereof, it is desirable to complicate the technique of bottle opening beyond the simple operation of merely twisting the cap in a given direction. Preferably the technique of opening the bottle should be sufficiently complicated so that a young child will be unable to remove the cap even after seeing the removal accomplished. The technique, however, should be simple enough so that it could be easily understood by an adult.

A safety closure has now been invented which permits the closure to be readily twisted onto the neck of a container but which requires the simultaneous operation of at least two steps to remove the closure. Generally a young child will not be able to simultaneously perform two operations to remove the closure.

DESCRIPTION OF THE PREFERRED EMBODIMENTS

Figure 1:
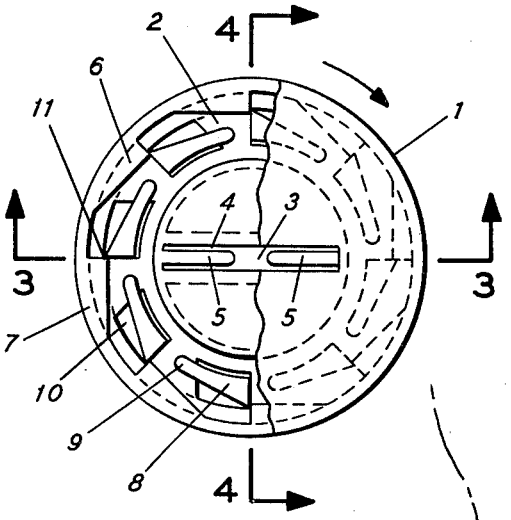
FIG. 1 is a top plan view in partial section of a preferred safety closure.

The safety closure of the present invention is adapted for use with a container having an externally threaded neck. In one particular embodiment of the present invention, the safety closure comprises:

a. an inner cap member having a top portion and a cylindrical collar portion extending axially therefrom, the cylindrical collar portion having internal threads mating with the threads on the neck of the container, the top of the inner cap member having a central longitudinal extending recess adapted to receive a key device;

b. an outer cap member having a top portion and a cylindrical collar portion extending axially therefrom, the collar portion fitting concentrically about the collar portion of the inner cap member, the outer cap member being freely rotatable relative to the inner cap member in the direction of loosening the inner cap member from the neck of container, the outer cap member and inner cap member having cooperable locking means for unidirectional coupling for simultaneous rotary movement to tighten the inner cap member on the neck of the container, the top of the outer cap member having a central longitudinal extending opening adapted to receive said key device and adapted to be moved into and out of alignment with the recess of the inner cap member by rotation of the outer cap member relative to the inner cap member, and c. means to prevent insertion of a key device into the aligned opening and recess without the application of pressure on the key device.

In another particularly preferred embodiment of the present invention, the safety closure comprises:

a. a screw cap member having a top portion and a cylindrical collar portion extending axially therefrom, the collar portion having internal threads mating with the threads on the neck of the container;

b. an intermediate cap member having a top portion and a cylindrical collar portion extending axially therefrom the collar portion fitting concentrically about the collar portion of the screw cap member, means to prevent relative rotation between the screw cap member and the intermediate cap member, the top of the intermediate cap member having a central longitudinal extending recess, notch or groove adapted to receive a key device;

c. an outer cap member having a top portion and a cylindrical collar portion extending axially therefrom, the cylindrical collar fitting concentrically about the collar of the intermediate cap member, the outer cap member being normally freely rotatable relative to the intermediate cap member in the direction of loosening the combination of the intermediate cap member and the screw cap member from the neck of the container, the outer cap member and intermediate cap member having cooperable locking means for unidirectional coupling for simultaneous rotary movement to tighten the combination of the intermediate cap member and screw cap member on the neck of the container, the top of the outer cap member having a central longitudinal extending opening adapted to receive said key device and adapted to be moved into and out of alignment with the recess, notch or groove of the intermediate cap member by rotation of the outer cap member relative to the intermediate cap member, and d. means to prevent insertion of a key device into the aligned opening and recess without the application of pressure on the key device.

Thus the safety closure of the present invention comprises an inner cap member (or an intermediate cap member and a screw cap member) adapted to be threaded tightly on the neck of a container and an outer cap member which substantially encloses the inner cap member (or combination of an intermediate cap member and screw cap member), which outer cap member is freely rotatable relative to the inner cap member (or combination of an intermediate cap member and a screw cap member) in the direction of loosening the inner cap member (or combination of an intermediate cap member and a screw cap member).

Thus, a person cannot simply by grasping the outer cap member remove the safety closure from the neck of the container. The inner cap member or intermediate cap member, as the case may be, is provided with a recess, notch or groove adapted to receive a key device. The outer cap member is provided with an opening adapted to receive said key device; the opening of the outer cap member is also adapted to be moved into and out of alignment with the recess, notch or groove of the inner cap member or intermediate cap member by rotation of the outer cap member relative to the inner cap member or intermediate cap member. Means are provided to prevent insertion of a key device into the aligned opening and recess, notch or groove without the application of pressure on the key device. Thus, even when the opening of the outer cap member is in alignment with the recess of the inner cap member or intermediate cap member a child will not be able to remove the safety closure from the neck of the container simply by insertion of the key device and twisting. The user must simultaneously apply pressure to the key device to hold it in the aligned opening of the outer cap member and recess of the inner cap member or intermediate cap member, and turn the outer cap member.

As is evident from the above, the present inventive safety closure can be defined either in terms of (1) an inner cap member and an outer cap member or in terms of (2) a screw cap member, intermediate cap member and outer cap member. The inner cap member of the safety closure will preferably comprise a planar top and a cylindrical collar extending axially from the planar top, the cylindrical collar having internal threads which mate with the threads on the neck of the container. The inner cap member by itself will screw on and off of the neck of the container. The top portion of the inner cap member must be adapted to engage and close the mouth of the container thereby preventing the removal of material; i.e., liquid from the container. The top portion of the inner cap member will have a central longitudinal extending recess, notch or groove therein. The recess must be of sufficient width and length to permit the insertion of a key device; i.e., a coin, such as a nickel, dime or quarter, etc., partially therein.

The outer cap member of the safety closure preferably has a planar top and a cylindrical collar extending axially therefrom, which collar fits concentrically about the collar of the inner cap member. Generally the cylindrical collar of the outer cap member will more than encompass the collar of the inner cap member. Also, preferably the cylindrical collar of the outer cap member at the open end will have a ridge or other means on the inner surface thereof so that once the outer cap member is fitted concentrically about the inner cap member the ridge or other means prevents easy removal of the outer cap member from the inner cap member. The outer cap member is normally freely rotatable relative to the inner cap member in the direction of loosening the inner cap member from the neck of the container. The outer cap member and inner cap member will have cooperable locking means for unidirectional coupling for simultaneous rotary movement to tighten the inner cap member on the neck of the container, the cooperable locking means, e.g., being in the form of pawls and teeth or in the form of an overriding clutch, etc. Preferably the inner cap member will have pawl engaging teeth thereon and the outer cap member will have downwardly extending ratchet means in the form of pawls. The pawls, of course, will be on the inner surface of the cylindrical collar generally abutting the inner surface of the top portion. However, if desired, the inner cap member can be provided with upwardly extending ratchet means in the form of pawls and the outer cap member provided with pawl engaging teeth. When the outer cap member is fitted over the inner cap member, the teeth and the pawls engage during clockwise rotation of the outer cap member thereby permitting tightening of the safety closure. However, in reverse rotation of the outer cap member, the teeth do not engage the pawls but slip over the pawls. Thus, the pawls must have a certain degree of flexibility to allow the teeth in one instance to engage them for tightening the safety closure on a container and in the other instance to slip by them when attempting to loosen the safety closure from the neck of the container without the use of a key device.

The top portion of the outer cap member will have a central longitudinal extending opening or slot adapted to receive a key device. Thus the opening should be of sufficient width and length to permit the entrance of a key device, for example, a coin. The opening of the outer cap member and the recess of the inner cap member should be of proper dimension so that when the opening and recess are in alignment a key device, e.g., a coin, can be inserted simultaneously into the opening and the recess. As a result of the outer cap member being freely rotatable relative to the inner cap member, the central longitudinal extending opening of the outer cap member can be easily moved into and out of alignment with the recess of the inner cap member.

Means are provided with the safety closure to prevent insertion of a key device into the opening of the outer cap member and recess of the inner cap member when they are in alignment with each other without the application of pressure on the key device. Preferably such means will be a spring device such as a metal wire which acts as a spring, or plastic or other tough, flexible material which is an integral part of the inner or outer cap member, preferably the outer cap member. A particularly desirable spring device will be plastic or similar material and generally of the same material as that with which the inner or outer cap member is made. Thus, the recess or opening, as the case may be, can be provided with a plastic integrally molded leaf spring at either end, the leaf springs serving as the spring device.

Inasmuch as the inner and outer cap member lock with each other for simultaneous rotary movement to tighten the inner cap member, it is very easy to screw the safety closure on the neck of the container. To unscrew the safety closure from the neck of the container, however, the opening of the outer cap member must be aligned with the recess of the inner cap member, a key device, such as a coin, inserted into the aligned opening of the outer cap member and recess of the inner cap member against resistance of the spring device, and the outer cap member turned or twisted. The insertion of this key device permits the inner and outer cap members to rotate in clockwise concentrical direction for removal of the safety closure. Overcoming the resistance of the means, for example a spring device, to prevent insertion of the key device into the aligned opening and recess while simultaneously turning the outer cap member adds a complication not easily performed by a child.

The safety closure can also comprise a screw cap member, an intermediate cap member and an outer cap member. The screw cap member will have a top portion, preferably a planar top, and a cylindrical collar extending axially therefrom, said cylindrical collar having internal threads mating with the threads on the neck of the container. The top portion of the screw cap member will be adapted to engage and close the mouth of the container. The metal screw caps found on many bottles and/or containers fall within the definition of the screw cap member. The intermediate cap member likewise comprises a top portion, preferably a planar top, and a cylindrical collar extending axially therefrom, the collar portion of the intermediate cap member fitting concentrically about the collar of the screw cap member. Means should be provided to prevent relative rotation between the screw cap member and the intermediate cap member. Thus, for example, the intermediate cap member and screw cap member can be glued to each other. More preferably, however, the outer surface of the cylindrical collar of the screw cap member will have longitudinal extending serrations. The inner surface of the cylindrical collar of the intermediate cap member will have a diameter to provide an interference fit with the serrations of the outer surface of the collar of the screw cap member. Ultrasonic energy will be employed to liquify the surface of the intermediate cap and cause the resin to flow into the serrations of the screw cap. Thus, the collar of the intermediate cap member conforms concentrically about the collar of the screw cap member so that for all intents and purposes the two members act as one.

The top of the intermediate cap member has a central longitudinal extending recess, notch or groove. It is necessary, of course, that the recess be of sufficient width and length so that a coin can be at least partially inserted therein. Preferably the means to prevent insertion of a key device into the aligned opening of the outer cap member and recess of the intermediate cap member without the application of pressure on the key device is associated with the intermediate cap member. Such means is preferably a spring device and may be in the form of a metal wire which acts as a spring or may be plastic or a flexible material which, preferably, is an integral part of the intermediate cap member. Preferably a plastic or similar material will be used and will be generally the same material with which the intermediate cap member is made. For example, the recess of a plastic intermediate cap member can be provided with plastic integrally molded leaf springs at each end.

The description of the outer cap member given above is applicable to the safety closure comprising a screw cap member, an intermediate cap member and an outer cap member. Thus, the outer cap member is freely rotatable relative to the intermediate cap member in the direction of loosening the combination of the intermediate cap member and the screw cap member from the neck of the container. The outer cap member and intermediate cap member will have cooperable locking means for unidirectional coupling for simultaneous rotary movement to tighten the combination of the container of the intermediate cap member and screw cap member on the neck of the container. Preferably the cooperable locking means will be in the form of ratchet teeth and pawls. Preferably, the intermediate cap member is provided with, for example, upwardly extending ratchet means in the form of pawls. The outer cap member will have pawl engaging teeth therein. The teeth will generally be formed on the inner surface of the cylindrical collar abutting the inner surface of the top portion of the outer cap member.

The inner and outer cap members may be constructed from a variety of materials, as for example, polypropylene, polyethylene, polystyrene, Bakelite, acetal resin or the like. Generally the inner cap member is made of a relatively hard, nonyielding plastic material such as acetal resin, polystyrene or Bakelite. The outer cap member is made of a more flexible resilient material such as polyethylene or polypropylene.

In the situation wherein the inner cap is considered as two parts, that is, an intermediate cap and a screw cap member, the intermediate cap will generally be of a relatively hard, nonyielding plastic material such as acetal resin, polystyrene or Bakelite, and the screw cap member will be of a metal such as, for example, aluminum, tin, steel, etc.

Generally the thickness of the top portion and cylindrical collar of the inner cap member, intermediate cap member, screw cap member or outer cap member will be no more than 0.040 inch to 0.050 inch. The opening and recess adapted for insertion of a key device will generally be from 0.600 inch to 0.620 inch long and 0.075 inch to 0.085 inch wide.

The subject invention can be more fully understood by reference to FIGS. 1 to 5 showing a preferred embodiment of the safety closure. In the figures, the safety closure is comprised of a screw cap member, an intermediate cap member and an outer cap member.

FIG. 1 is a top plan view in partial section of the safety closure. The planar top of the outer cap member 1 is partially sectioned to show features of intermediate cap member 2 as well as features of the outer cap member 1. The opening 3 in outer cap member 1 is in alignment with the recess or notch 4 of intermediate cap member 2. The leaf spring members 5 are shown as being integrally molded with the intermediate cap member 2. Ratchet teeth 6 are shown as being integrally molded with the cylindrical collar 7 of outer cap member 1. The pawls 8 are connected or molded to the intermediate cap member only at position 9. Space 10 has been cut away from the intermediate cap member 2 during manufacture of the intermediate cap member so that the pawls 8 are not connected to the intermediate cap member except at position 9. In FIG. 1, the outer cap member 1 is in position relative to the intermediate cap member 2 for tightening the safety closure on the neck of the container. Thus, it is noted that ratchet teeth 6 are abutting the pawls 8 at, for example, position 11. As the outer cap member is turned clockwise, the interlocking of ratchet teeth 6 with pawls 8 cause the intermediate cap member 2 to rotate simultaneously with the outer cap member 1.

Figure 2:
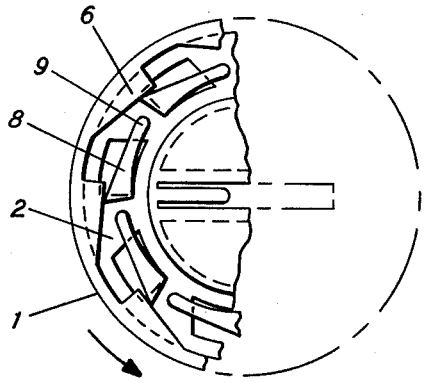
FIG. 2 is a partial sectional view of the safety closure embodying the present invention.

FIG. 2, which is a top plan view in partial section similar to that of FIG. 1, illustrates the situation of attempting to unloosen the safety closure from the neck of the container without the use of a key device. The ratchet teeth 6 of outer cap member 1 pass over pawls 8 of intermediate cap member 2 when rotating the outer cap member 1 in a counterclockwise direction relative to the intermediate cap member 2. Thus, the outer cap member 1 rotates freely relative to the intermediate cap member 2 when rotating the outer cap member 1 counterclockwise. Pawls 8 deflect slightly as teeth 6 pass over them. The pawls 8 which are connected or molded to the intermediate cap member 2 only at position 9 have a degree of flexibility which enables them to deflect slightly as the teeth 6 pass over them.

Thus, as clearly seen from FIGS. 1 and 2, teeth 6 and pawls 8 are so designed that they will lock to rotate the intermediate and outer cap members together when torque is applied in the direction to screw the safety closure onto the neck of a container. They will not lock when torque is applied in the opposite direction. In other words, in this modification the outer and intermediate cap members will rotate together when they are being applied to the neck of the container but will rotate one relative to another when torque is applied in the opposite direction unless a key device is used to engage the intermediate and outer cap members.

Figure 3:
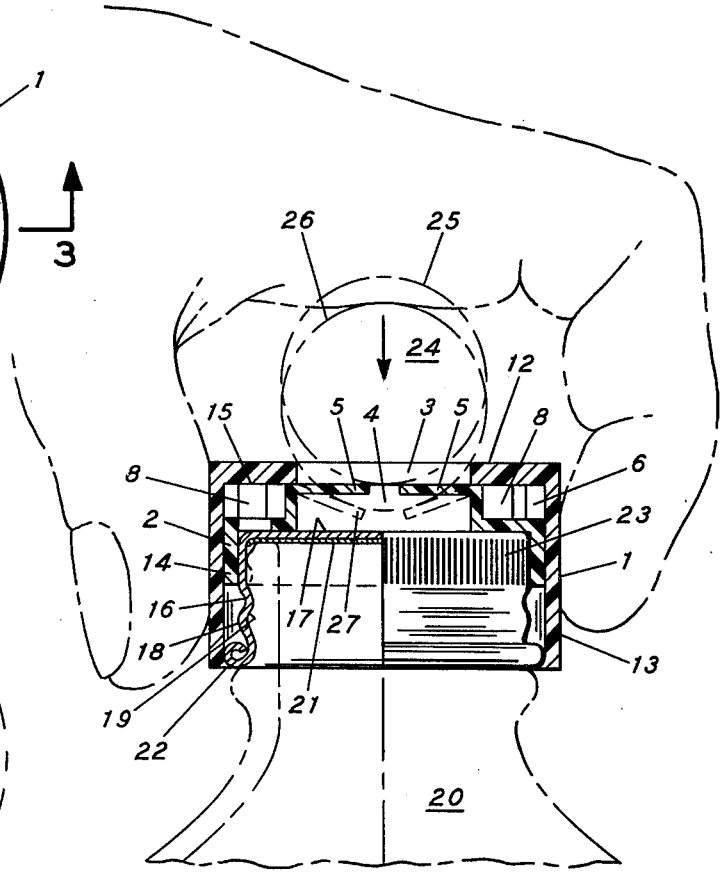
FIG. 3 is a sectional view of the safety closure along lines 3—3′ of FIG. 1, showing the relationship of a key device; e.g., coin, to the safety closure.

FIG. 3 is a sectional view along the lines 3–3' of FIG. 1. Outer cap member 1 having planar top 12 and cylindrical collar 13 fits concentrically about the intermediate cap member 2. Intermediate cap member 2 has cylindrical collar 14 and planar top 15 and fits concentrically about screw cap member 16. Screw cap member 16 comprises a planar top 17 and cylindrical collar 18 extending axially therefrom, the cylindrical collar 18 having internal threads 19 mating with the threads on the neck of the container 20. The planar top 17 of the screw cap member 16 is adapted to engage and close the mouth of the container 20 and to aid in this purpose, a cardboard insert 21 is provided on the inner surface of planar top 17 of screw cap member 16. Outer cap member 1 has a small ridge 22 at the open end of the inner surface of cylindrical collar 13. Outer cap member 1 is of sufficient size so that when the outer cap member 1 is placed concentrically about the intermediate cap member 2 the ridge 22 fits slightly around the bottom of screw cap member 16 thereby preventing easy removal of the outer cap member 1. The exterior surface of cylindrical collar 18 of screw cap member 16 is provided with longitudinal extending serrations 23. The inner surface of cylindrical collar 14 of intermediate cap member 2 likewise has longitudinal extending serrations. Thus the intermediate cap member 2 fits very tightly concentrically about the collar 18 of screw cap member 16 and for all intents and purposes the intermediate cap member 2 and screw cap member 16 act as one unit. The intermediate cap member 2 has pawls 8 extending upwardly to engage teeth 6 of outer cap member 1.

Coin 24 in FIG. 3 is shown in two positions— in position 25 and position 26. The coin 24 in position 25 has entered slot 3 of outer cap member 1 and is resting against leaf springs 5 of intermediate cap member 2. The leaf springs 5 prevent coin 24 from entering the recess 4 of the intermediate cap member 2 unless pressure is applied to the coin 24. When downward pressure is exerted on coin 24 so that it is in position 26 the coin 24 deflects the leaf springs 5 into a new position 27; the coin 24 is now through opening 3 and into the recess 4 of intermediate cap member 2. When the coin 24 is in position 26, the outer and intermediate cap members are in effect locked together so that torque applied to the outer cap member 1 in a counterclockwise direction will loosen the safety closure from the neck of the container.

Figure 4:
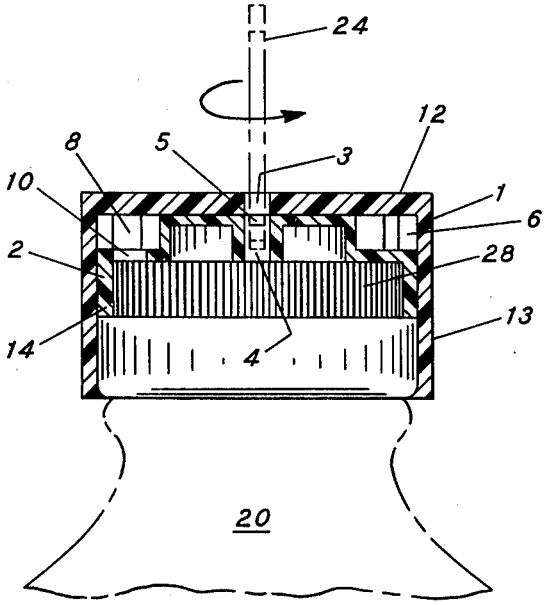
FIG. 4 is a sectional view taken on line 4—4′ of FIG. 1 showing a coin in operative relationship thereto.

FIG. 4 is a sectional view along the lines 4—4' of FIG. 1. Outer cap member 1 comprises a planar top 12 and cylindrical collar 13 fits concentrically about the cylindrical collar 14 of intermediate cap member 2. Pawls 8 and teeth 6 are shown as well as the opening 10 in the surface of the intermediate cap member 2. The serrations 28 on the intermediate cap member 2 are also shown. FIG. 4 illustrates the two-step operation necessary to remove the safety closure from the neck of the container. Thus, it is necessary to depress the coin 24 to overcome the resistance of the leaf springs for entrance of the coin 24 into the aligned opening 3 of outer cap member 1 and recess 4 of intermediate cap member 2 while turning the outer cap member 1 in a counterclockwise direction. Small children will not be able to perform the function of both depressing the coin against the resistance of the leaf springs and turning the outer cap member with the coin thus depressed.

Figure 5:
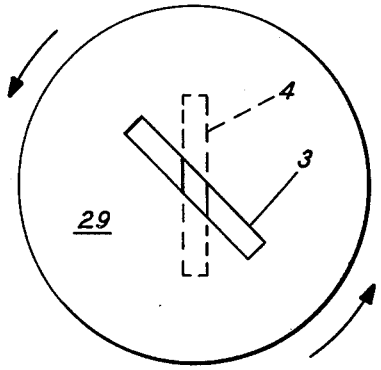
FIG. 5 is a top plan view of the safety closure.

FIG. 5 is a top plan view of the safety closure embodying the present invention. Numerical FIG. 29 applies generally to the safety closure. The longitudinal extending opening 3 of the outer cap member is shown as being out of alignment with the longitudinal extending recess 4 of the intermediate cap member. The leaf springs are not shown in FIG. 5. Before a coin can be inserted, it is necessary, of course, that the outer cap member be located counterclockwise until opening 3 is in alignment with recess 4. This is an additional step which increases the safety of the closure against accidental opening by a small child. Generally, a small child will not readily be able to align opening 3 with recess 4.

As will be evident to those skilled in the art, various modifications of this invention can be made or followed, in the light of the foregoing disclosure and discussion, without departing from the spirit or scope of the disclosure or from the scope of the following claims.

We claim:

1. Safety closure for a container having an externally threaded neck comprising:

a. an inner cap member having a top portion and a cylindrical collar portion extending axially therefrom, said cylindrical collar portion having internal threads mating with the threads on the neck of the container, said top of the inner cap member having a central longitudinal extending recess adapted to receive a key device;

b. an outer cap member having a top portion and a cylindrical collar portion extending axially therefrom, said collar portion fitting concentrically about said collar portion of the inner cap member, the outer cap member being freely rotatable relative to the inner cap member in the direction of loosening the inner cap member from the neck of the container, the outer cap member and inner cap member having cooperable locking means for unidirectional coupling for simultaneous rotary movement to tighten the inner cap member on the neck of the container, the top of the outer cap member having a central longitudinal extending opening adapted to receive said key device, and adapted to be moved into and out of alignment with said recess of the inner cap member by rotation of the outer cap member relative to the inner cap member, and c. means to prevent insertion of a key device into the aligned said opening and said recess without the application of pressure on the key device.

2. The safety closure of claim 1, wherein the means to prevent insertion of a key device into the aligned said opening and said recess without the application of pressure on the key device is a spring device associated with the outer cap member.

3. The safety closure of claim 1, wherein the cooperable locking means for the outer cap member and inner cap member comprises pawls and ratchet teeth.

4. The safety closure of claim 1, wherein the inner and outer cap members are constructed from polypropylene, polyethylene, polystyrene or acetal resin.

5. Safety closure for a container having an externally threaded neck which comprises:

a. a screw cap member having a top portion and a cylindrical collar portion extending axially therefrom, said collar portion having internal threads mating with the threads on the neck of the container;

b. an intermediate cap member having a top portion and a cylindrical collar portion extending axially therefrom, said collar portion fitting concentrically about the collar of the screw cap member, means to prevent relative rotation between said screw cap member and said intermediate cap member, the top of said intermediate cap member having a central longitudinal extending recess adapted to receive a key device;

c. an outer cap member having a top portion and a cylindrical collar portion extending axially therefrom, said cylindrical collar fitting concentrically about the collar of the intermediate cap member, the outer cap member being normally freely rotatable relative to the intermediate cap member in the direction of loosening the combination of the intermediate cap member and screw cap member from the neck of the container, the outer cap member and intermediate cap member having cooperable locking means for unidirectional coupling for simultaneous rotary movement to tighten the combination of intermediate cap member and screw cap member on the neck of the container, the top portion of the outer cap member having a central longitudinal extending opening adapted to receive said key device and adapted to be rotated into and out of alignment with the recess of the intermediate cap member by rotation of the outer cap member relative to the intermediate cap member; and d. means to prevent insertion of a key device into said aligned opening and said recess without the application of pressure upon the key device.

6. The safety closure of claim 1, wherein the means to prevent insertion of a key device into said aligned opening and said recess without the application of pressure on the key device is a spring device associated with the intermediate cap member.

7. The safety closure of claim 5, wherein the cooperable locking means comprises pawls and ratchet teeth, the pawls being associated with the intermediate cap member and the ratchet teeth being associated with the outer cap member.

* * * * *